United States Patent [19]

Nijs

[11] 4,004,396

[45] Jan. 25, 1977

[54] METHOD FOR PACKING COILS OF WIRE NETTING

[75] Inventor: Marc Nijs, Harelbeke, Belgium

[73] Assignee: N.V. Bekaert S.A., Zwevegem, Belgium

[22] Filed: June 24, 1975

[21] Appl. No.: 589,921

Related U.S. Application Data

[62] Division of Ser. No. 482,900, June 25, 1974, Pat. No. 3,929,226.

[30] Foreign Application Priority Data

July 3, 1973 United Kingdom ..... 31631/73

[52] U.S. Cl. ..... 53/14; 53/30 S; 206/413

[51] Int. Cl.² ..... B65B 53/02

[58] Field of Search ..... 53/14, 3, 30; 206/416, 206/413, 407, 497

[56] References Cited

UNITED STATES PATENTS

| | | | |
|---|---|---|---|
| 1,603,959 | 10/1926 | Leven | 206/413 |
| 3,585,775 | 6/1971 | Stenniken | 206/497 X |
| 3,878,940 | 4/1975 | Wittebort | 206/416 |

*Primary Examiner*—Leon Gilden
*Attorney, Agent, or Firm*—Shlesinger, Arkwright, Garvey and Dinsmore

[57] ABSTRACT

A method of packing a wire netting coil by laying over each end of the coil a protective end cover having a plurality of tongues hingedly connected thereto, introducing the tongues into the coil in sufficient independent frictional engagement with the coil to keep the end covers in place, and subsequently tightly enclosing the coil with the thusly affixed end covers into a packing sheet.

6 Claims, 7 Drawing Figures

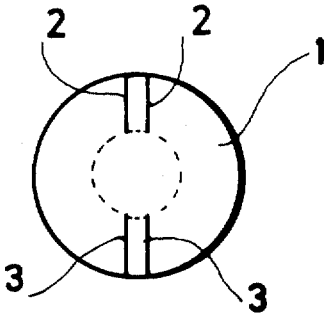
FIG. 1
FIG. 2
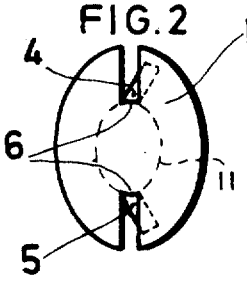
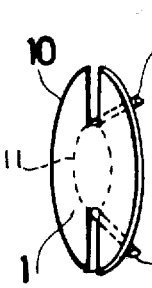
FIG. 3 a
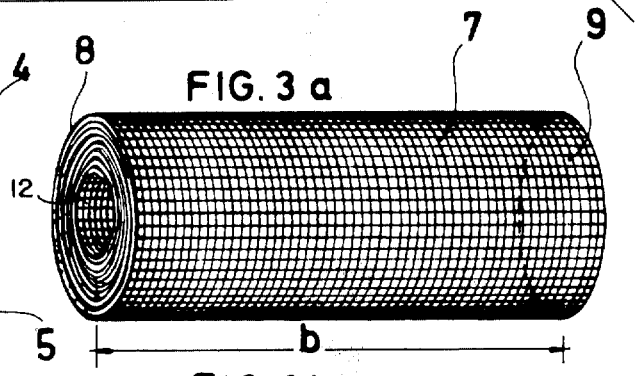
FIG. 4
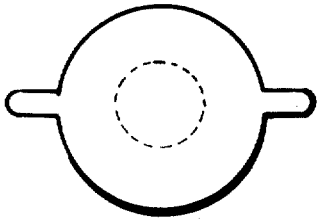
FIG. 3 b
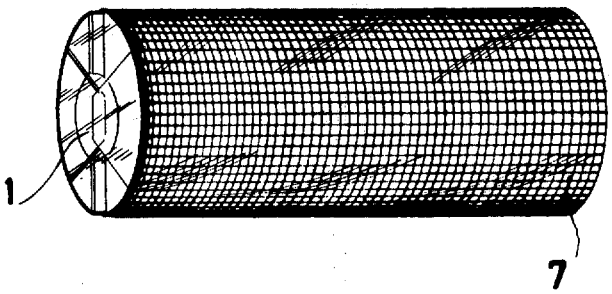
FIG. 5a
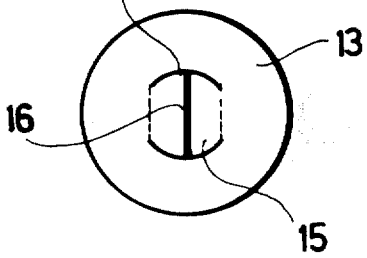
FIG. 5b
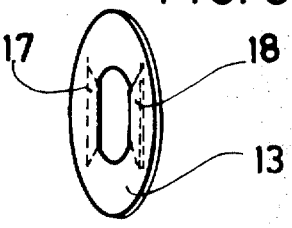

METHOD FOR PACKING COILS OF WIRE NETTING

This is a division of application Ser. No. 482,900, filed June 25, 1974 now U.S. Pat. No. 3,929,226.

BACKGROUND AND OBJECTS

In the manufacture of wire netting, such as welded square or diamond mesh, the netting is made in the form of long strips which are coiled up as it is made. These coils have a generally cylindrical shape and are usually packed for transport. The ends of the coil are rough and in most cases the ends of some of the wires forming the netting project from the ends of the coil. For this reason a protective paper or corrugated cardboard end cover is folded and fixed over each end to form a cap, and then the coil is wrapped. In other cases where very good protection is needed, the coils are packed in cylindrical or prismatic cardboard boxes.

As a result of modern methods of distribution and more efficient transport methods, the demands on transport packaging have increased constantly, but of course higher packaging costs increase the total cost of the product or decrease its margin of profit. For this reason a good quality and cheap packing method is of great importance, especially a method employing a minimum of labor. In recent times shrink plastic film packaging has been developed. In this method a film of shrink plastic such as polyethylene is laid loosely around the product whereafter the packed product is placed in an oven which causes the film to shrink and to tighten itself around the product. It is possible to make a loose packing in a simple machine and the shrinking leaves the product tightly packed.

When such shrink film packing is applied to coils of wire netting, it is still necessary to have a protective end cover on each end of the coil before it is placed in the packing machine, because the film upon shrinking and during further transport and handling would be perforated by the projecting wire ends at the ends of the coil. For this reason, a protective covering cap is fixed to each end and it is desirable that this be done using a minimum of labor excluding e.g. the need of making knots or other time consuming operations. Although the problem of cheaply fixing an end cover on the ends of a coil has grown in signifiance with the development of shrink film packing, it should be noted that this problem also exists in other methods of packing where the coil is tightly enclosed into a packing sheet, e.g. of paper, and that the invention is not limited to the shrink film packing method alone.

Viewed from one aspect, the invention provides a method of packing a wire netting coil, said method including laying over each end of the coil a protective end cover having at least one tongue hingedly connected thereto, said tongue or tongues being introduced into the coil as to enter into sufficiently total frictional and clamped relationship with the coil material as to keep the end cover in place, and subsequently tightly enclosing said coil with the thusly affixed end covers into a packing sheet.

Viewed from another aspect, the invention provides a packing for a wire netting coil, said packing including a sheet tightly enclosing said coil, and, on each end of said coil at the inside of said sheet, a protective end cover having at least one tongue hingedly connected thereto and entering the coil, the tongue or tongues being in sufficient total frictional and clamped relationship with the coil material to keep alone the end covers in place.

In order that the covers may be attached to the coil by a quick, simple method, the tongues are arranged so that they may be pushed into the coil to be held there between the layers of network or in the meshes or in the hollow core of the coil. Such covers are not difficult to make, and it is preferred to form the tongues simply by cutting them from the cover over a part of the circumference of the tongue, in such a way that it can be folded over into said coil over the remaining part of said circumference. This cutting step can readily be performed when the cover itself is being cut from a sheet of material, and folding occurs during the introduction of the tongues into the coil.

In general a wire netting coil has a hollow core, and in this case the end cover sheet is preferably a substantially circular flat disk having two opposite radially extending tongues extending from the circumference of the disk to the circumference of a concentric circle having substantially the diameter of said hollow core. The tongues are folded over transverse to the plane of the disk and along said circumference of said concentric circle, introduced into the core to such a depth that the disk abuts the end of the coil, and then released so that the tongues push against the inner surface of the core. To this end, the material of the disk in the region of the fold has sufficient resilience to push both tongues against the inner surface of the hollow core to keep the disk in place.

BRIEF DESCRIPTION OF THE DRAWINGS

Some embodiments of the invention will now be described by way of example and with reference to the accompanying drawings in which:

FIG. 1 is a plan view of an end cover in the form of a flat disk, for use in the invention, with unfolded tongues;

FIG. 2 is a perspective view of the end cover of FIG. 1, after folding the tongues;

FIG. 3*a* and 3*b* are perspective views showing how the end cover fits on the end of a coil of wire netting with FIG. 3*b* showing the coil and end covers enclosed in a packing sheet; and FIGS. 4 and 5*a* and 5*b* show other types of end covers for use in accordance with the invention.

DETAILED DESCRIPTION

In FIG. 1 a cover sheet is shown in the form of a circular flat disk 1 having a first pair of parallel cuts 2 of equal length extending approximately radially from the circumference of the disk towards, but not as far as, the center. Opposite the cuts 2 there are two other similar parallel cuts 3. Such disks are easy to take between the thumb and forefinger and push the disk material from between the cuts to thereby form two tongues 4 and 5 which are folded over along the lines 6, as shown in FIG. 2.

FIG. 3 shows how the disks are put in place. FIG. 3*a* shows an unpacked wire netting coil 7 of welded square or diamond mesh, or of woven square or hexagonal mesh or of any other wire netting suitable for fencing or other use, which may be a strip of width *b* and which has been rolled up lengthwise. Such a coil has the form of a cylinder having two ends 8 and 9 and includes a hollow core 12 which has a diameter generally in the range between 5 and 20 cm, depending on the type of netting and its stiffness. The ends 8 and 9 are approximately planar and circular, but are rough and comprise a multitude of projections formed by the cut ends of the wires of the netting which would prick the plastic shrink film or cause damage to other types of packing. In order to avoid this, a protective end cover is laid over each end 8 and 9 of the coil. The disk 1 used as a protective end cover is the type illustrated in FIGS. 1 and 2, and which is shown again in FIG. 3*a* in a position for placing on the end 8 of the coil 7. FIG. 3*a* shows the two opposite radially extending tongues 4 and 5 extending from the circumference 10 of the disk to the circumference 11 of a concentric circle having substantially the diameter of the hollow core 12 of the coil, the tongues being folded over for insertion into the core 12. The two tongues 4 and 5 are folded over and introduced into the core 12 of the coil as deeply as possible until the disk abuts the end 8 of the coil (FIG. 3*b*).

The material of the disk 1 is usually cardboard, which has a certain resilience against folding so that the tongues 4 and 5 have a tendency to open again. By this movement they bear firmly on the inner surface of the hollow core 12 so that the disk, when released, is kept in place against the end of the coil. A similar disk is placed on the other end of the coil and then the coil can be introduced into an automatic packing machine. In general, the operation of fitting the disks will be done on a coil which is moving on a conveyor towards a packing machine. It is clear however that the advantages of the use of such disks are also present when the coils are not packed in automatic machines, although these advantages are more significant when the elimination of manual labor is more important.

The protective end cover is not limited to the form of a flat disk, but preferably has a form adapted to abut the end of the coil and to prevent the projections resulting from the cut extremities of the wire in the netting from perforating the packing material laid over the end cover. Neither is the invention limited as to the form of cuts in the end cover in order to obtain the projecting tongues, nor as to the way in which these projecting tongues keep the end cover in place. The tongues need not be tied or fixed in a complicated way, it being necessary only that the tongue is sufficiently clamped or held in frictional engagement to keep the end cover in place awaiting further tight packing by any type of sheet in such a way that it must not be held in place through other means. Thus, the tongues may be clamped between consecutive layers of the mesh, or they may have additional folds to enable them to be introduced more easily into the meshes of the inner surface of the core. The sum of clamping and frictional forces between the tongues and the netting, without any assistance from stitches or other additional tying material, should be sufficient to keep the disk in place.

The invention is not limited to the form of the tongues, but any tongue configuration can be employed in accordance with this invention. It is sufficient that the end cover should comprise at least one tongue hingedly connected thereto and preferably cut out from the end cover material over a part of the periphery of the tongue and joined to the end cover over another part of this periphery where it is folded over. This means that the tongue is made by cutting the cover material over a part of the periphery of a configuration in the cover, and by leaving intact another part of the periphery, so that the lip can be folded over. FIG. 4 shows an example of tongues extending diametrically outwardly of the edge of the disk and which can be folded over and introduced into the meshes of the netting at the external surface of the coil. FIG. 5 shows another example of an end cover for use in the invention. This end cover has the form of a circular disk 3 having substantially the external diameter of the coil. In this disk a number of cuts are made (FIG. 5*a*): two cuts along two diametrically opposite arcs 14 and 15 of a circle concentric with the circumference of the disk and of a diameter of about the internal diameter of the hollow core of the corresponding coil, and a cut along the diameter 16 of this circle, preferably the diameter which connects the centres of the arcs. The arcs preferably extend over at least 90° each. Such an end cover disk is taken and applied to the end of the corresponding coil, whilst the two tongues 17 and 18 which are formed by the cuts are folded over along the dotted lines and pushed into the hollow core of the coil (FIG. 5*b*).

The material of the cover is not limited to cardboard, but plastics or other suitable material may be used. When, however, as in the case of the end cover shown in FIG. 1 to 3, the tendency of the lips to unfold is employed to hold the cover against the coil end, then it is necessary that the material of the end cover in the region of the fold be sufficiently resilient.

I claim:

1. A method of packing a wire netting coil comprising:

laying over each end of said coil a protective end cover having a plurality of tongues hingedly connected thereto, said tongues being introduced into said coil in sufficient independent frictional engagement with said coil to keep said end covers in place, said frictional engagement being accomplished independently of any additional element, and subsequently tightly enclosing said coil with the thusly affixed end covers into a packing sheet.

2. A method according to claim 1 in which method said coil with the thusly affixed end covers are enclosed into a shrinkable plastic film packing sheet.

3. A method according to claim 1, in which method the end cover has at least one tongue cut from the end cover over a part of the circumference of the tongue and in which method the tongue is folded over into said coil over the remaining part of said circumference.

4. A method according to claim 3 in which method said coil with the thusly affixed end covers are enclosed into a shrinkable plastic film packing sheet.

5. A method according to claim 2, in which method said coil includes a hollow core, and said end cover has the form of a substantially circular flat disk with two opposite radially extending tongues extending from the circumference of the disk to the circumference of a concentric circle having substantially the diameter of said hollow core, and in which method said tongues are folded over transverse to the plane of the disk and along said circumference of said concentric circle, and introduced into the core to such a depth that the disk abuts the end of the coil, and are released so that the tongues push against the inner surface of the hollow core.

6. A method according to claim 5 in which method said coil with the thusly affixed end covers are enclosed into a shrinkable plastic film packing sheet.

* * * * *